US010827290B2

(12) United States Patent
Valenzuela

(10) Patent No.: US 10,827,290 B2
(45) Date of Patent: Nov. 3, 2020

(54) TRI-COMFORT TIPS WITH LOW FREQUENCY LEAKAGE AND VENTED FOR BACK PRESSURE AND SUCTION RELIEF

(71) Applicant: Acouva, Inc., San Francisco, CA (US)

(72) Inventor: Victor Manuel Valenzuela, Hayward, CA (US)

(73) Assignee: ACOUVA, INC., San Francisco, CA (US)

( * ) Notice: Subject to any disclaimer, the term of this patent is extended or adjusted under 35 U.S.C. 154(b) by 0 days.

(21) Appl. No.: 16/298,082

(22) Filed: Mar. 11, 2019

(65) Prior Publication Data

US 2020/0275220 A1 Aug. 27, 2020

Related U.S. Application Data

(63) Continuation-in-part of application No. 16/285,012, filed on Feb. 25, 2019, now abandoned.

(51) Int. Cl.
*H04R 25/00* (2006.01)
*H04R 1/10* (2006.01)

(52) U.S. Cl.
CPC ..... *H04R 25/656* (2013.01); *H04R 1/1016* (2013.01)

(58) Field of Classification Search
CPC ..... H04R 25/656; H04R 1/1016
USPC ..... 381/328
See application file for complete search history.

(56) References Cited

U.S. PATENT DOCUMENTS

| | | | | |
|---|---|---|---|---|
| 6,205,227 | B1 * | 3/2001 | Mahoney | H04R 25/60 381/328 |
| 6,513,621 | B1 | 2/2003 | DesLauriers | |
| 6,724,902 | B1 * | 4/2004 | Shennib | H04R 25/456 381/322 |
| 7,664,282 | B2 * | 2/2010 | Urso | H04R 25/656 381/328 |
| 8,340,335 | B1 * | 12/2012 | Shennib | H04R 25/60 381/328 |
| 9,456,285 | B2 * | 9/2016 | Bymaster | H04R 25/602 |
| 9,479,859 | B2 * | 10/2016 | Henry | H04R 1/1016 |
| 9,532,127 | B2 * | 12/2016 | Burton | H04R 1/1016 |
| 9,769,577 | B2 * | 9/2017 | Shennib | H04R 25/558 |
| 9,805,590 | B2 * | 10/2017 | Shennib | H04R 25/558 |
| 9,807,524 | B2 * | 10/2017 | Shennib | H04R 25/652 |
| 9,814,625 | B2 * | 11/2017 | Ely | A61F 11/08 |
| 10,052,234 | B2 * | 8/2018 | Ely | A61F 11/08 |
| 10,219,064 | B1 * | 2/2019 | Valenzuela | H04R 1/105 |
| 10,242,565 | B2 * | 3/2019 | Shennib | G08C 17/02 |
| 10,582,285 | B2 * | 3/2020 | Valenzuela | H04R 1/1058 |
| D883,491 | S * | 5/2020 | Ponti | D24/174 |
| 2006/0115105 | A1 | 6/2006 | Brumback | |
| 2008/0187159 | A1 * | 8/2008 | Blanchard | A61F 11/08 381/328 |

(Continued)

*Primary Examiner* — Phylesha Dabney
(74) *Attorney, Agent, or Firm* — Growth IP

(57) ABSTRACT

Embodiments can include Tri-comfort Tips comprising a set of leakage slits for in-ear breathability for infection prevention and maintaining dryness of an inner portion of a user's ear canal, wherein the Tri-comfort Tips are configured to reside in the user's ear canal within a first bend of the user's ear canal, wherein the Tri-comfort Tips comprise an end configured to reside in the user's ear canal at a distance less than 16 millimeters from the entrance of the user's ear canal.

17 Claims, 10 Drawing Sheets

(56) References Cited

U.S. PATENT DOCUMENTS

| | | | | |
|---|---|---|---|---|
| 2008/0226113 | A1* | 9/2008 | Kuhtz | H04R 1/1016 381/375 |
| 2009/0034775 | A1* | 2/2009 | Burton | H04R 1/1016 381/380 |
| 2010/0272299 | A1* | 10/2010 | Van Schuylenbergh | H04R 25/554 381/315 |
| 2011/0034218 | A1 | 2/2011 | Sung et al. | |
| 2011/0058697 | A1* | 3/2011 | Shennib | H04R 25/602 381/314 |
| 2011/0223864 | A1* | 9/2011 | Wai | H04R 25/656 455/41.3 |
| 2011/0274296 | A1* | 11/2011 | Wai | H04R 1/1016 381/121 |
| 2013/0188819 | A1 | 7/2013 | Young-Mun | |
| 2013/0243229 | A1* | 9/2013 | Shennib | H04R 25/602 381/323 |
| 2014/0153762 | A1 | 6/2014 | Shennib | |
| 2014/0254843 | A1* | 9/2014 | Shennib | H04R 25/65 381/323 |
| 2014/0254844 | A1* | 9/2014 | Shennib | H04R 25/65 381/323 |
| 2016/0066110 | A1 | 3/2016 | Shennib | |
| 2019/0104354 | A1* | 4/2019 | Valenzuela | H04R 1/1041 |

* cited by examiner

TRI-COMFORT TIPS WITH LOW FREQUENCY LEAKAGE AND VENTED FOR BACK PRESSURE AND SUCTION RELIEF

CROSS-REFERENCE TO RELATED APPLICATIONS

The present application is a continuation-in-part of and claims priority to U.S. patent application Ser. No. 16/285,012 filed 25 Feb. 2019, which is a continuation of U.S. patent application Ser. No. 15/950,122, filed 10 Apr. 2018, each of which are incorporated in their entirety herein by this reference.

TECHNICAL FIELD

The disclosure generally relates to one or more tips for one or more devices.

BACKGROUND

The following background description includes information that may be useful in understanding context in relation to embodiments described herein. The background description is not an admission that any of the information provided herein is prior art or relevant to the embodiments, or that any publication specifically or implicitly referenced is prior art.

With the development of portable multimedia devices and smart phones, many types of in-ear pieces—such as earphones and headsets—have been developed. However, conventional ear-tips/domes can traditionally be bulky and uncomfortable as well as limited in their technological abilities. For example, in order to get them to fit properly, they have to be trimmed to fit properly; this is time consuming and costly.

Therefore, a need exists for improvement and advancements, such as in relation to form factors and/or associated features.

BRIEF DESCRIPTION OF THE FIGURES

Figures provided herein may or may not be provided to scale. The relative dimensions or proportions may vary. Embodiments can be sized to fit within an extra small to large ear canal of a user.

DESCRIPTION OF EMBODIMENTS

Figure 1:
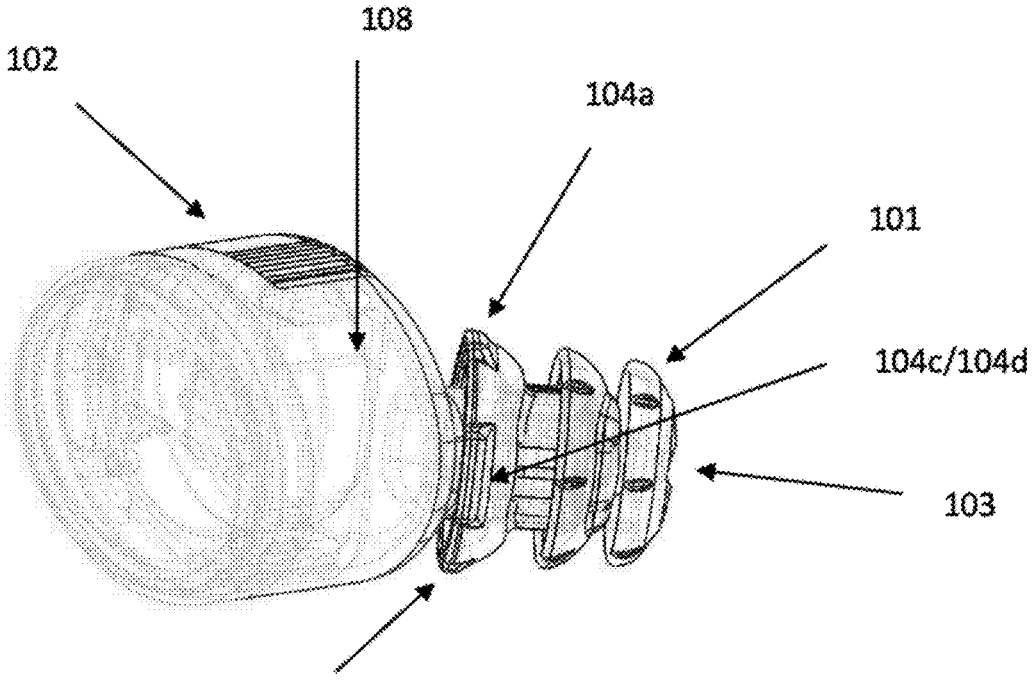
FIG. 1 illustrates an example of a wireless in-ear utility device 102 including a solid device and a Tri-comfort Tips 101, according to an embodiment of the technology.
Figure 2:
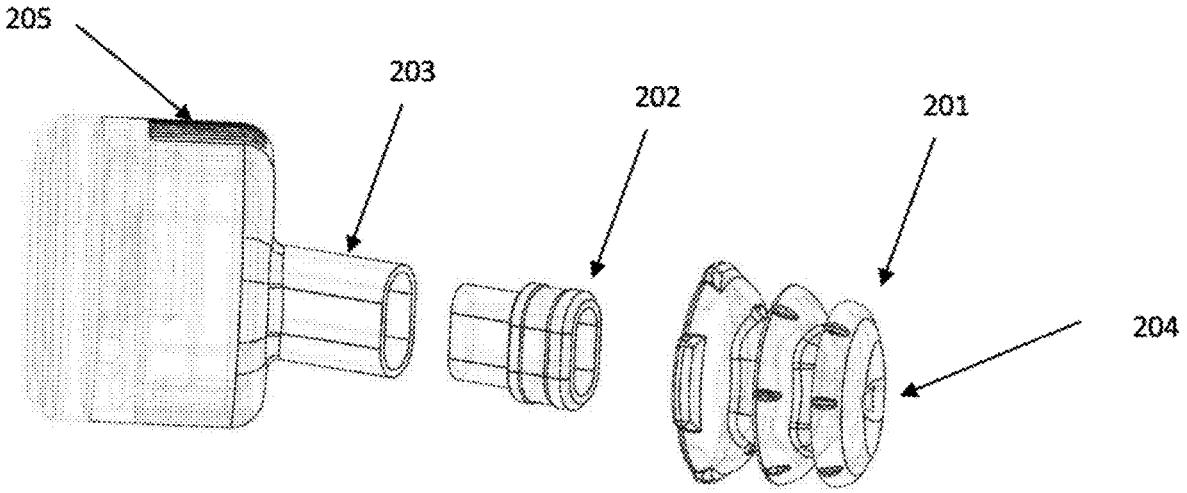
FIG. 2 illustrates an example of an embodiment of the technology in which a Tri-comfort Tips outer circumference of the Tri-comfort Tips 201 has been designed to accommodate an oval outer shape that mimics the ear canal that attaches to a wireless in-ear utility device 102, such as the in-ear main trunk support 203 shown on the solid device shown in FIG. 2, and where the insert horn 202 is designed to allow for the Tri-comfort Tips to snap on and increase amplification, and where the insert horn is permanently attached to 203, according to an embodiment of the technology.
Figure 3:
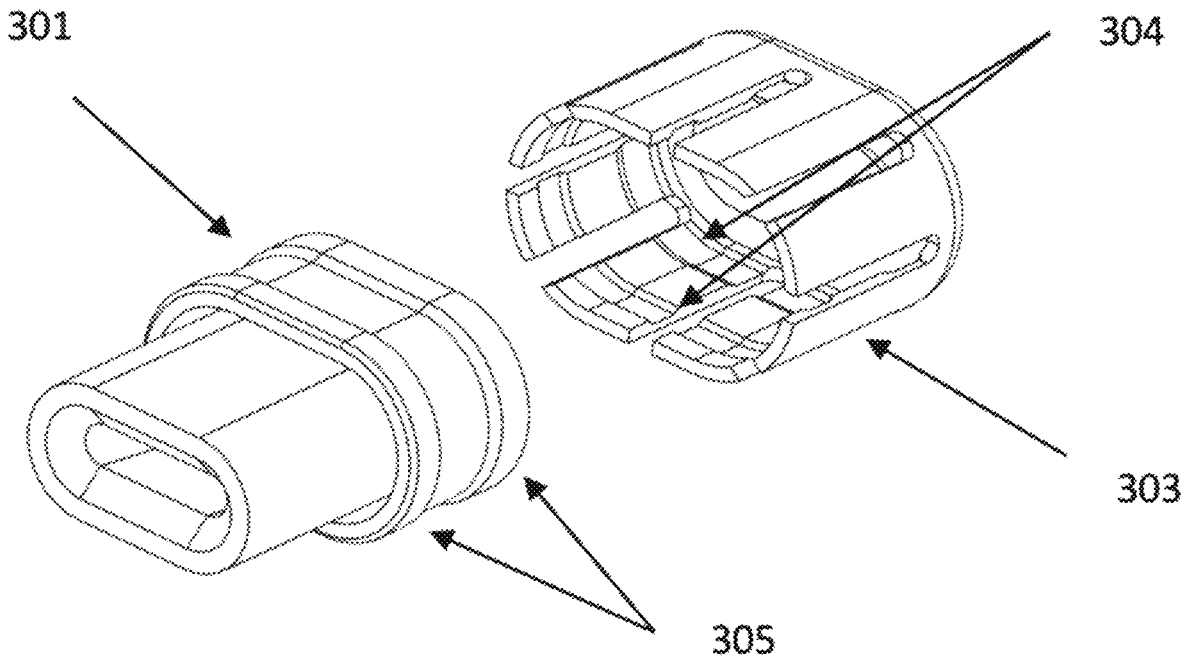
FIG. 3 includes an illustration of an in-ear utility device, with Tri-comfort Tips not shown, and where the Tri-comfort Tips can connect with component 303 to snap on and off of protrusions 301 and 305 that engage with indent features 304, according to a variation of an embodiment.
Figure 4:
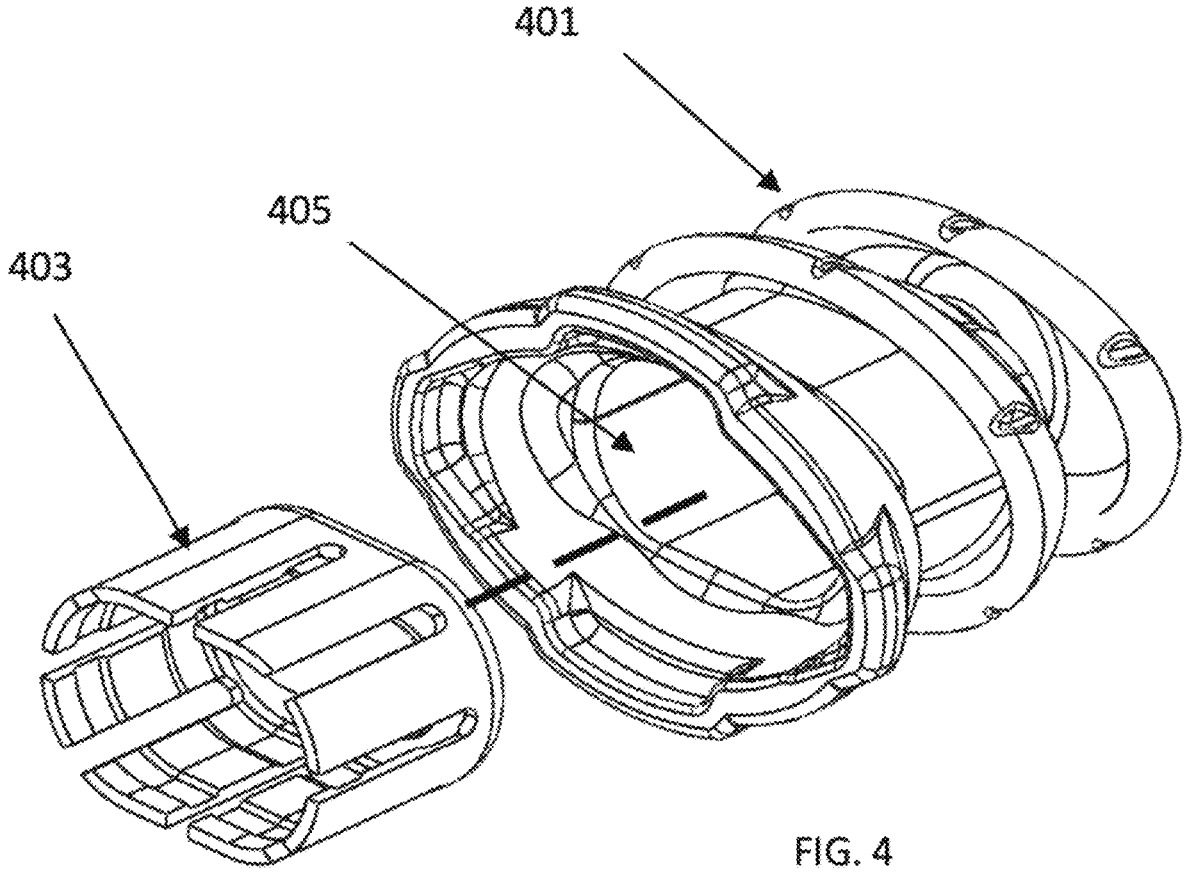
FIG. 4 illustrates an example of an embodiment of a retainer lock 403 being inserted into an oval cavity 405 on a Tri-comfort Tips 401, and designed to work with any other in-ear utility device/Hearing Aids being inserted into an oval cavity 405, according to an embodiment of the technology.

The following description of the embodiments is not intended to limit the invention to these embodiments, but rather to enable any person skilled in the art to make and use.

In embodiments (e.g., of the system) can include Tri-comfort Tips with low frequency leakage from 50 Hz to 300 Hz/retention/acoustic/In-ear breathability/Back Pressure relief/and/or Suction Relief. Embodiments can include Tri-comfort Tips for in-ear utility devices configured to provide low frequency filtering in the range of 50 Hz to 300 Hz to balance occlusion and high quality sound output performance for playing music and balance when used for Hearing Aids, such as in place of the typical Dome seals/ear buds tips that do not work well in one space versus the other. Embodiments can include Tri-comfort Tips configured and designed to work in both with hearing aids and as wearable ear tips.

In embodiments, the Tri-comfort Tips retention can be designed for comfort and each tip works independently to engage with a slight force with the inner ear canal, therefore when attached to any wearable/hearing aids it will prevent it from falling out of the users ears and requiring a pull off force of 0.125 Lbs to 0.25 Lbs (and/or any suitable amount of force) to remove it from any utility devices.

In specific examples, Tri-comfort Tips can be designed to mimic the ear canal shape therefore eliminating the need for trimming the seal tips in order to fit properly.

Embodiments can include Tri-comfort Tips with low frequency leakage from 50 Hz to 300 Hz/retention/acoustic/IN-ear breathability/Back Pressure relief/and/or Suction Relief, which can be designed for comfort of wearing for long periods of time and under a variety of conditions while preventing damage to the ear drum such as by overcoming issues of conventional technologies that do not allow the sound backpressure/moisture to have means of escaping through vented channels.

Embodiments can include and/or provide an improved Tri-comfort Tips for use with a wireless in-ear utility device and/or hearing aids.

In embodiments, the improved Tri-comfort Tips includes a Frequency Filter for low leakage in the range of 50 Hz to 300 Hz. In examples, the Frequency Filter allows the Tri-comfort Tips to respond to higher sound quality performance in the user's ear when then in-ear utility device is worn to listen to music and/or used as hearing aids, as Tri-comfort Tips can prevent the occlusion affect In embodiments, the improved Tri-comfort Tips can additionally or alternatively include a separate attachment that's in line with the speaker chamber port opening that has been designed to utilize this port to stream audio through. In examples, this separate attachment of the speaker chamber port in the Tri-comfort Tips will cause a significant increase in the level of protection via the membrane filter of 25 to 30 micron opening keeping the speaker chamber of the in-ear utility device open and allowing for audio sound to pass through this separate attachment, which can allow the speaker chamber port of the Tri-comfort Tips in-ear utility device to produce higher sound quality.

Embodiments of a system can include a set of leakage slits for in-ear breathability for infection prevention and maintaining dryness of an inner portion of a user's ear canal, such as where the Tri-comfort Tips are configured to reside in the user's ear canal within a first bend of the ear canal, and/or where the Tri-comfort Tips include an end configured to reside in the user's ear canal at a distance less than 16 millimeters from the entrance of the user's ear canal. In examples, the set of leakage slits provide back pressure relief as sound pressure is built up and when inserting seals of the into the user's ear canal, thereby enabling pressure equilibrium with an ambient ear portion. In examples, the set of leakage slits provide suction relief when removing the seals from the users ear canal, for preventing pain and ear drum damage.

The set of leakage slits can allow frequency leakage in the range of 50 Hz to 200 Hz. In examples, the frequency leakage (e.g., via the set of leakage slits, etc.) enables increased output gain while reducing feedback noise from at least one of a microphone and a speaker associated with the Tri-comfort Tips, for improving hearing of a human voice (e.g., preventing a user feeling of wearing ear plugs, etc.).

In examples, the set of leakage slits (e.g., with the frequency leakage in the range of 50 Hz to 200 Hz, etc.) can be adapted to listen to outside ambient noise without completely blocking outside noise, which can help with safety to allow for the user to be aware of their surroundings, such as when used with in-ear wearable devices and/or playing music the Tri-comfort Tips (e.g., where the leakage slits contrast with ear plugs, etc.).

In examples, a width and a length of the set of leakage slits is adapted for defining the frequency leakage in the range of 50 Hz to 200 Hz (and/or any suitable range). Width, length, and/or any suitable size-related aspect of the set of leakage slits and/or other suitable components can be designed for the low frequency leakage (50 Hz to 200 Hz) and/or for any suitable range of frequency leakage.

Embodiments can include Tri-comfort Tips including three individual seal tips (e.g., including a set of leakage slits, etc.), which can be each a different size, where the three individual seal tips include a first seal, a second seal with a second seal circumference at least 15% smaller (and/or any suitable relative size) than a first seal circumference of the first seal, and a third seal with a third seal circumference at least 15% smaller (and/or any suitable relative size) than the second seal circumference, and/or where the first seal is configured to apply different forces within the user's ear canal from low to medium force, such as for facilitating superior retention within the ear canal and to reduce discomfort. In examples, the first seal (and/or suitable seal) includes at least four outer structural supports (and/or any suitable number and type of structural supports, etc.) for improving retention within an entrance of the user's ear canal (e.g., preventing the seal from distorting within the user's ear canal, etc.).

In examples, a form factor of the three individual seal tips can be adapted to the user's ear canal, and/or where the form factor is configured to allowing the three individual seal tips to each apply different forces within the user's ear canal and/or for the three individual seal tips to apply similar within the circumference of the user's ear canal, which can facilitate superior retention within the ear canal and to reduce discomfort. In examples, the form factor of the three individual seal tips can be configured to enable improved entry into the user's ear canal and/or to prevent rotation of one or more utility devices when the one or more utility devices are connected to the Tri-comfort Tips.

In examples, the three individual seal tips are each a specific distance from each other for reducing overlapping areas that result in reduced sound output quality from over-compression, such as where the overlap can create buckling and/or over-compression, therefore potentially blocking the speaker (e.g., Receiver) port and reducing the sound output quality by being over compressed, and/or where the specific distances can facilitate superior retention within the ear canal and to reduce discomfort.

In examples, the three individual seal tips are at least 3 mm away from the first bend of the user's ear canal (e.g., and/or where the three individual seal tips are each the specific distance from each other while maintaining an overall length of the Tri-comfort Tips as from 12 mm to 16 mm, such as for prevent the Tri-comfort Tips from buckling and potentially blocking the speaker (Receiver) port and reducing the sound output quality (e.g., achieved by keeping a safe distance of 3 mm to 5 mm away from the user's first bend of the ear canal, etc.), where this can prevent the user from experiencing discomfort.

In examples, the set of leakage slits include a first set of leakage slits proximal an ear drum of the user's ear canal, and/or where the first set of leakage slits includes at least six leakage slits (and/or any suitable number of leakage slits), and/or where the middle seal (e.g., middle-sized seal tip of the three individual seal tips; etc.) can include at least six leakage slits and/or any suitable number of leakage slits.

Embodiments of the wireless in-ear utility device can be used for a variety of purposes and include a variety of electronic packages, such as for use as a Psap, hearing aids, for use as a music player, headphone device, for use in various external health-monitoring applications accessories, and/or for any suitable application requiring and/or usable with an improved in-ear tips/domes. Embodiments can provide a wireless in-ear utility device configured to have a variety of electronic packages. The electronic packages may serve a variety of functions, such as a Bluetooth device, noise cancellation device that allows the user to focus on sounds of interest, a health-awareness monitoring and safety awareness monitoring, fitness device, such as where embodiments or internal accessories devices can include the sensors and electronic configuration needed to carry out its mission in configuration with wireless in-ear utility device, such as where such application can require and/or be usable with improved in ear tips/domes (e.g., Tri-comfort Tips, etc.).

In examples, the Tri-comfort Tips is configured to be snapped off from an in-ear utility device by a user to facilitate replacement with a second Tri-comfort Tips. In examples, is associated with a snap-off force from 1.5 to 2.5 lbs. for removal from the in-ear utility device (e.g., for facilitating safety through ensuring that the Tri-comfort Tips do not remain dislodged in a user's ear canal, etc.).

Embodiments of the system (e.g., one or more Tri-comfort Tips, one or more in-ear utility devices, one or more remote computing systems, and/or other suitable components described herein, etc.) and/or portions of embodiments of the system can entirely or partially be executed by, hosted on, communicate with, and/or otherwise include: one or more Tri-comfort Tips, in-ear utility devices, remote computing systems (e.g., a server, at least one networked computing system, stateless, stateful; etc.), local computing systems, user devices, databases (e.g., storing user audio profiles, storing user preferences, etc.), and/or any suitable component.

Communication by and/or between any components of the system can include wireless communication (e.g., WiFi, Bluetooth, radiofrequency, etc.) and/or wired communication.

The components of the system 100 can be physically and/or logically integrated in any manner (e.g., with any suitable distributions of functionality across the components, such as in relation to portions of the method; etc.). However, distribution of functionality across components of the system 100 can be configured in any suitable manner.

In variations, components of the system 200 can be positioned at (e.g., mounted at, integrated with, located proximal, etc.) any suitable location (e.g., relative an ear canal; relative another ear region of a user; relative another body region of the user; relative an in-ear utility device; relative other components of the system; etc.). Additionally or alternatively, components of the system can be integrated with any suitable existing components (e.g., databases, user devices, other audiology devices, etc.). However, the system and method can be configured in any suitable manner.

However one or more Tri-comfort Tips, associated functionality, and/or associated components can be configured in any suitable manner.

FIG. 1 includes an illustration of an example of a wireless in-ear utility device 102 including a solid device, and a Tri-comfort Tips 101, according to an embodiment of the technology. In an example, the Tri-comfort Tips 101 is shown separated from the solid device, but in an example of operation, the Tri-comfort Tips 101 can fit over (and/or otherwise connect to) an in-ear main trunk support 105 extending from the solid device, wireless in-ear utility device 102, according to an embodiment of the technology. Tri-comfort Tips can also be known as "seals tips" or "Domes."

The Tri-comfort Tips 101 can function to optimize the quality of the acoustic sound performance and to provide the user's ear with improved breathability for improved in-ear health, according to an embodiment of the technology. Additionally or alternatively, the Tri-comfort Tips and/or other components of the system can confer any suitable benefits.

The Tri-comfort Tips 101 can include a special frequency filter portion residing on the perimeter of the Tri-comfort Tips 101 (e.g., when the wireless in-ear utility device 102 is in operation, etc.), but the Tri-comfort Tips can include any suitable frequency filters (e.g., filtering for any suitable frequency ranges) positioned at any suitable location relative other components of the Tri-comfort Tips 101. In examples, the Tri-comfort Tips 101 can include four support struts 104*a*, 104*b*, 104*c* and 104*d* designed to provide engagement at the entrance of the ear canal portion of the user's ear.

In examples, when the wireless in-ear utility device 102 is inserted into the user's ear during operation, the Tri-comfort Tips 101 can rest inside the user's ear canal, and sounds may be played from the speaker chamber 108 to the user via a speaker chamber port 204, which in examples, represents the part of the wireless in-ear utility device 102 residing furthest from the user's ear drum, which can allow for improved performance for output sound quality without being distorted.

In embodiments, the wireless in-ear utility device 102 does not touch the user's ear canal at any point during operation, and where the Tri-comfort Tips 101 can be compressed at 10% to 15% (and/or other suitable compression amount) in the ear canal of the user, which can allow for retention of the utility device for preventing the utility device from falling out of the user's ears. In examples, the Tri-comfort Tips 101 does not cover portions of the in-ear utility device outside of the user's ear canal, according to an embodiment of the technology.

In embodiments, the Tri-comfort Tips 101 is designed to configure and mimic the inner regions of the Ear canal, allowing for improved comfort between the wireless in-ear utility device 102 and the ear canal, according to an embodiment of the technology. In examples, these channels can lower pressure in the ear canal. Additionally or alternatively, the channels can serve the purpose of allowing ambient sounds at low frequency from 50 Hz to 300 Hz to pass through to the user's eardrum, but the channels can be adapted to any suitable frequency ranges. Thus, in examples, a user wearing the in-ear utility device 102 may continue to experience ambient sounds in a natural manner (e.g., low constant frequencies sound), and to experience the user's own voice to sound more natural to him/her, which can confer improvements over conventional ear bud devices and/or other suitable devices. Additionally or alternatively, in variations, the solid device 102 will not touch areas of the ear canal, which can increase user comfort and provide better in ear breathability and comfort, allowing the in-ear utility device 102 to be worn for extended periods of time, according to an embodiment of the technology.

In variations, the Tri-comfort Tips 101 allow the portion of the solid device body 102 that rests in the user's ear canal (e.g., the in-ear main trunk support 105) to reside safely in the ear canal. In examples, the solid device body 102 can include electrical components that do not typically touch the user's ear canal. The presence of the Tri-comfort Tips 101 can protect the user against potential malfunctions of an in-ear wireless device and/or other suitable devices. For example, if a device develops a short or extreme heat, the user can be protected due to the presence of the Tri-comfort Tips 101. Additionally or alternatively, in examples, the user can be protected by the Tri-comfort Tips 101 due to construction with bio-compatible materials and a design to be an insulator to protect the user's in-ear canal from harm. However, any suitable benefits and functionality can be conferred from the interaction between Tri-comfort Tips 101 and in-ear utility devices 102, and/or from the design of the Tri-comfort Tips 101.

The distance of the in-ear utility device 102 can vary based on the depth of the user's ear canal. Some users have shallow ear canals while other users have deep ear canals. Therefore, the in-ear utility device 102, the Tri-comfort Tips 101 and/or other suitable components can be designed to keep a distance of the in-ear utility device 102 (e.g., a predetermined threshold distance) to keep a particular depth from the user eardrum.

In variations, the distal end (e.g., the outer end of the solid device 101 of the in-ear utility device 102) resides just outside the user's ear so that the in-ear utility device 102 may be easily removed by hand, according to an embodiment of the technology. In some embodiments of the technology, the in-ear utility device 102 might reside inside the ear canal with no part of the device outside the ear, but such an embodiment would still be inserted into the ear canal as for the Tri-comfort Tips and easily removed by a hand. However, the distal end and/or other suitable portions of the in-ear utility device 102 and/or Tri-comfort Tips 101 can reside at any suitable location relative other components, relative one or more ear regions, and/or can be positioned at any suitable location.

The wireless in-ear utility device can include a speaker chamber 108, according to an embodiment of the technology. In some embodiments, the speaker chamber 108 will not contact the eardrum and will not need any assistance of an audiologist. In some embodiments of the technology, the in-ear utility device may reside in a broader range to the user's eardrum (e.g., 1 mm to 30 mm away; 3 mm to 30 mm away; etc.). Additionally or alternatively, the in-ear utility device can reside at a location that provides improved sound quality to the user while also residing at a distance that does not require the employment of an audiologist to satisfy health and safety regulations. However, the speaker chamber 108 and/or other suitable components can be positioned at any suitable location.

In embodiments, the speaker chamber 108 can include a size greater than speaker chambers conventionally included in Bluetooth devices and/or other suitable devices. In examples, larger speaker chambers 108 in combination with a smaller form factor in-ear utility device 102 can result in positioning during operation where components rest into the user's Concha bowl of the user's ear more so than a conventional Bluetooth device and/or other suitable devices. However, the speaker chamber 108 can be of any suitable size.

In variations, an electronic component package can be fixed inside, mounted on, and/or embedded in or on the solid device body 101 of the in-ear utility device 102, according to an embodiment of the technology. This electronic component package can include components such as the speaker chamber 108, according to an embodiment of the technology. In embodiments, the size of the electronic component package can be selected based on the size and/or other characteristics of the Tri-comfort Tips (e.g., selecting a reduced size of the electronic component package to accommodate the size of the Tri-comfort Tips, etc.). Thus, in examples, the specific components in the electronic component package can be selected and/or packaged into a smaller form factor size, in addition to other characteristics, which can prevent harmonic distortion (e.g., below 3% of better; any suitable degree of improvement; etc.) and/or prevent feedback noise between the Mic and Speaker chamber, which can be designed to be isolated from each other, according to an embodiment of the technology. However, components described herein can include any suitable relative sizes.

In examples, the Tri-comfort Tips can conform without distortion when the in-ear utility device 102 is inserted into a user's ear canal without damaging the in-ear utility device 102 or causing harm to the user's ear. In examples, the conformability to the user's ear canal Tri-comfort Tips can cushion the user's ear canal from 102 causing any discomfort.

The Tri-comfort Tips can be adapted to improve comfort for the user in order for the user to be able to wear the in-ear utility device 102 for long periods of time (e.g., any suitable period of time; constantly; etc.). In variations, the Tri-comfort Tips can be designed so that they can compress 10% to 15% (and/or other suitable compression amount) into the user's ear canal without buckling or deforming, which can improve user comfort. Tri-comfort Tip materials (e.g., biocompatible materials silicone materials, etc.) can additionally or alternatively improve user comfort.

Human ear canals can have an oval shape. Embodiments of the Tri-comfort Tips 101 can be constructed at any suitable size, such as for covering a wide range of oval ear canal sizes. Thus, in examples, the Tri-comfort Tips 101 can be constructed in a variety of sizes (e.g., by varying size, dimensions, weight, and/or other suitable parameters of any suitable components of the Tri-comfort Tips, such as while maintaining the solid device body 102 to be manufactured in a single size, etc.), according to an embodiment of the technology. For example, the Tri-comfort Tips 101 covering the trunk of the device 203 can account for variations in size of user's ear canals (e.g., extra small, small, medium, large and extra large). However, the Tri-comfort Tips 101 and/or any other suitable components thereof can be of any suitable size, form factor, dimensions, and weight.

The Tri-comfort Tips 101 can be fabricated from any suitable resilient polymeric materials, according to an embodiment of the technology. In variations, the Tri-comfort Tips can be constructed from resilient polymeric materials of medical grade purity material. In specific examples, the Tri-comfort Tips 101 (e.g., covering the in-ear utility device 102; etc.) is formed of a material that has a Shore A Durometer value between 20-30 (and/or can have any suitable durometer value), which can allow the material to flow freely in the mold while fabricating the Tri-comfort Tips, such as to achieve flexibility (e.g., which can be controlled by the wall thickness, such as of 0.01 to 0.030 of an inch thick; etc.), which can allow for in-ear comfort and the Tri-comfort Tips to compress from 10% to 15% (and/or other suitable compression amount) with no discomfort and allowing for wireless in-ear utility device 102 to have continuous retention in the use's ears for extended periods of time, according to an embodiment of the technology. Additionally or alternatively, natural rubber, neoprene rubber, SBR rubber (styrene block copolymer compounds), silicone rubber, EPDM rubber, polybutadiene rubber, polyvinylchloride elastomers, polyurethane elastomers, ethylene vinyls, acetate elastomers, elastomers based on acrylic acid precursors and vinyhalide polymers can be used for construction of the Tri-comfort Tips 101. However, the Tri-comfort Tips can be constructed with any combination of any suitable materials.

Any number of tasks may be performed on the in-ear utility device 102, according to an embodiment of the technology. The wireless in-ear utility device 102 and the solid device portion 101 may include a variety of in-ear devices, such as hearing aids and wearable devices. In a variation, the device electronics reside in the solid device and not in the Tri-comfort Tips 101, but the system can include any suitable distribution of components across the solid device and the Tri-comfort Tips 101. The wireless in-ear utility device 102 can include a wireless in-ear utility device 102 of the type described in U.S. patent application Ser. No. 15/950,110, entitled "In-Ear Wireless Device With Bone Conduction Mic Communication", filed 10 Apr. 2018, which is herein incorporated by reference in entirety.

The Tri-comfort Tips 101 can be designed in any suitable shapes. However, the Tri-comfort Tips 101 can be configured in any suitable manner.

Figure 5:
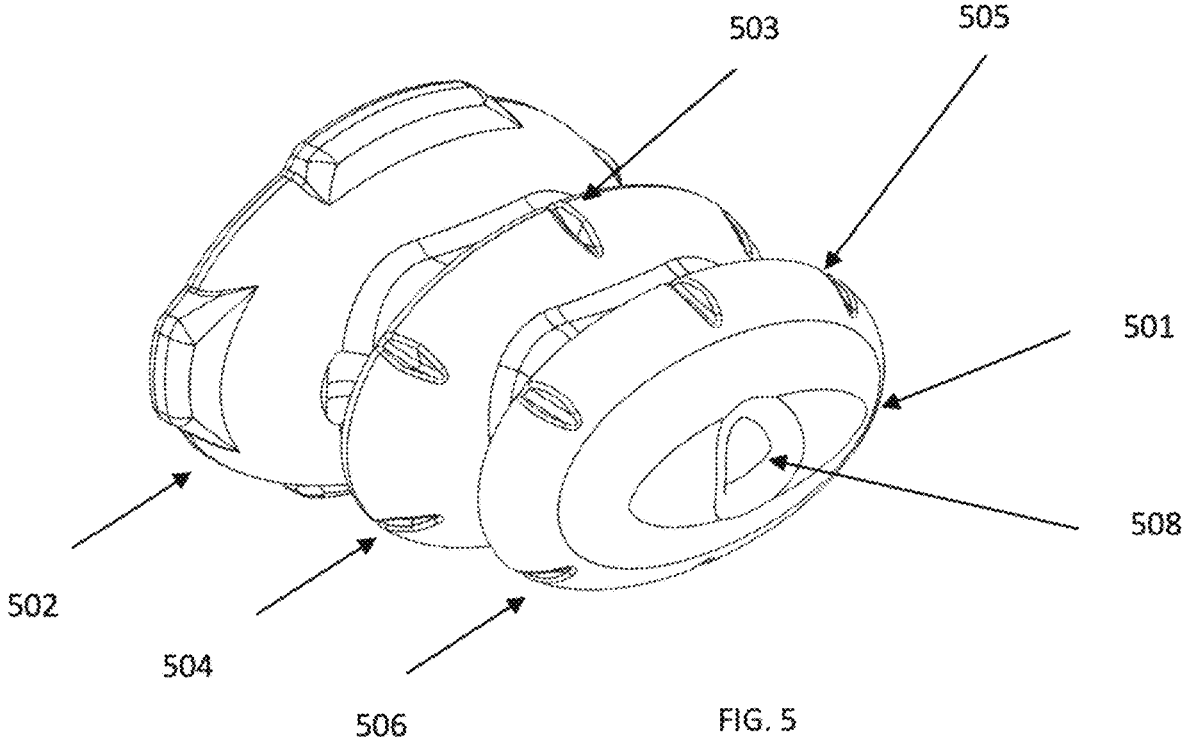
FIG. 5 includes an illustration of a Tri-comfort Tips 501 including twelve frequency filters 503, 505, where 6 are positioned on the middle seal tip and 6 are positioned on the outer seal tip 505, where the slits work in conjunction to allow for low frequency filtering in the range of 50 Hz to 300 Hz and where port 508 can be used for sound to pass through, according to a variation of an embodiment.

FIG. 5 illustrates the Frequency Filter 503, 505 in the open position to allow Frequency leakage in the low frequency 50 Hz to 300 Hz, where the Tri-comfort Tips 501 can obtain optimum the acoustic sound performance. The user can receive the best acoustic performance from sounds emitted by a speaker chamber on the wireless in-ear utility device (e.g., the wireless in-ear utility device 102 shown in FIG. 1). Sounds from the wireless in-ear utility device can be emitted via the speaker chamber to port 508 on the Tri-comfort Tips 501, according to an embodiment of the technology. The speaker chamber port 508 can allow sounds from a speaker chamber on the solid device to be transmitted to the user's ear.

The Frequency Filter 503, 505 can additionally or alternatively be designed to prevent back pressure between the backend of the Tri-comfort Tips 501 and the user's ear drum cavity. Having the channels 503, 505 open and only allowing low frequency to pass through from 50 Hz and 300 Hz can protect the user's ear drum from sudden loud noises.

Thus, the Frequency Filter 503, 505 can relieve excessive pressure on all three tips 502,504 and 506 of the Tri-comfort Tips 501, which can help to prevent any harm to the user's eardrum.

Figure 6:
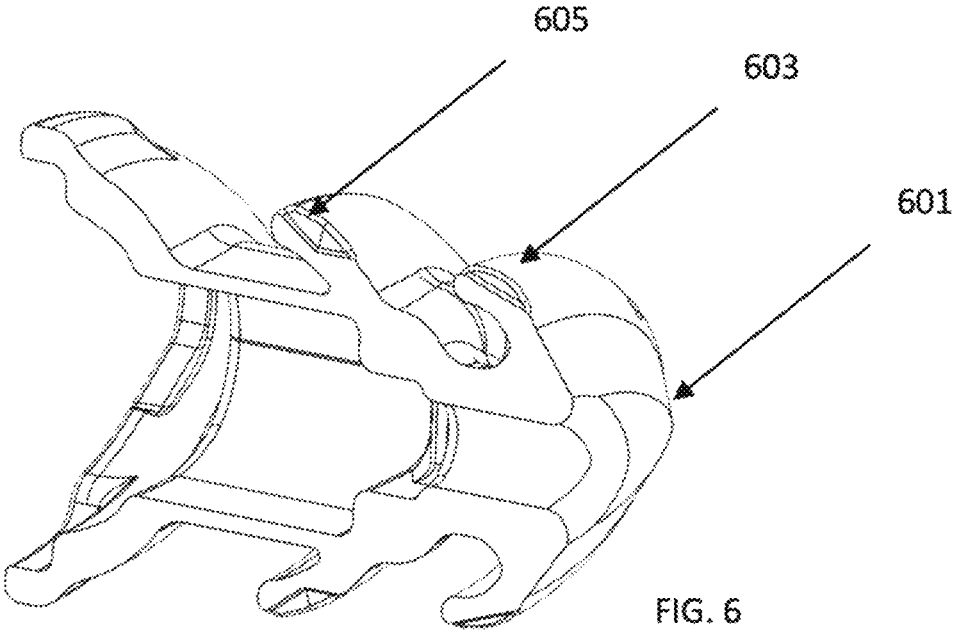
FIG. 6 includes an illustration of Frequency Filter 603, 605 of a Tri-comfort Tips 601 shown in a cut away image that allows for backpressure relief/suction relief/low frequency filtering in the range of 50 Hz to 300 Hz, according to a variation of an embodiment.

FIG. 6 illustrates Frequency Filter 603, 605 of a Tri-comfort Tips 601 shown in a cut away image, according to an embodiment of the technology. When the channels 603, 605, the Tri-comfort Tips 601 can attain its optimum acoustic sound performance.

The channels 603 and 605 can be designed to relieve buildup of back pressure between the backend of the Tri-comfort Tips 601 and the user's ear drum cavity. Opening the channels 603 can allow excess air to pass through to relieve pressure. The channels 605 can operates similarly to the channels 603, but can differ with directionality more focused into the ear canal and can allow air to pass through, due to the channel 605 being open. Having the channels 603, 605 open can protect the user's ear drum from sudden loud noises and sudden changes in pressure. However, the channels 603 and 605 can have any suitable openings for providing any suitable functionality in relation pass-through air, pressure, and other suitable aspects.

The channels 603, 605 can allow pressure to return to safe levels. Embodiments of the channels 603, 605 can additionally or alternatively include characteristics of channels further disclosed herein, including but not limited to.

Figure 7:
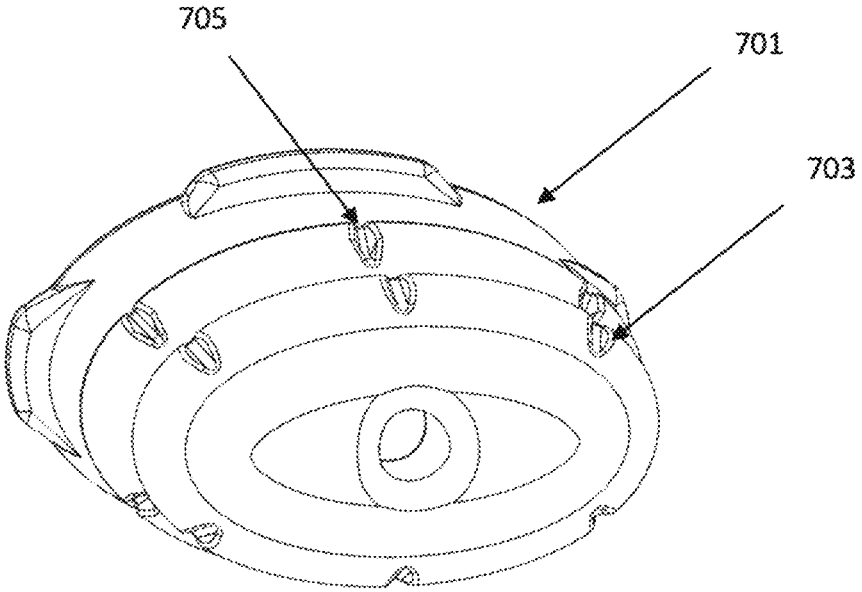
FIG. 7 includes an illustration of Frequency Filter 703, 705 shown from the backend of Tri-comfort Tips 701, where the combination of 703, 705 can allow for breathability of the ear canal backpressure relief/suction relief/low frequency filtering in the range of 50 Hz to 300 Hz, according to a variation of an embodiment.

FIG. 7 illustrates examples of Frequency Filter 703, 705 shown from the backend of Tri-comfort Tips 701, according to an embodiment of the technology. As shown in FIG. 07 a channel 703 on a Tri-comfort Tips 701 is shown, according to an embodiment of the technology. Excessive pressure that may have built up by sound or a change in altitude can be relieved through the channels 703 and 705 into the atmosphere.

The Frequency Filter 703, 705 can be designed open to prevent pressure that could be excessive or approaching excess, according to an embodiment of the technology.

Once pressure has been relieved, the Frequency Filter 703, 705 can automatically facilitate optimal acoustic performance levels, according to an embodiment of the technology. As discussed herein, the Frequency Filter 703, 705 can include channels that are designed specifically to allow low frequencies from 50 Hz to 300 Hz to escape from the Tri-comfort Tips 701, acting as Frequency Filter 703, 705, according to an embodiment of the technology.

Figure 8:
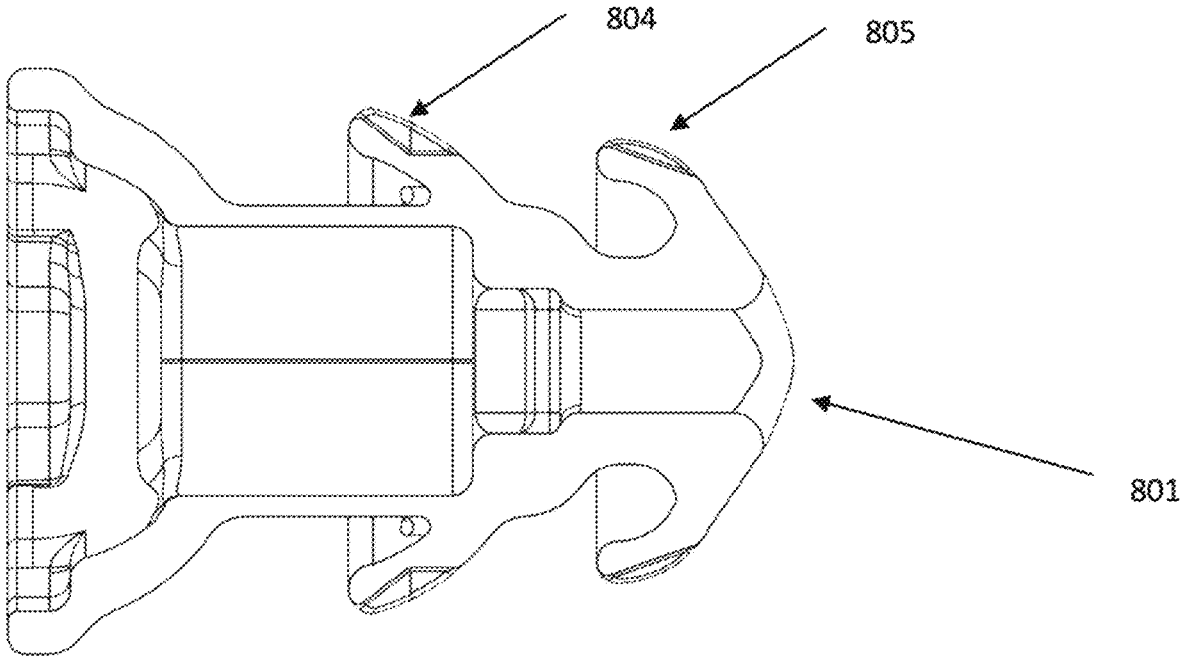
FIG. 8 includes an illustration of Frequency Filter 804 and 805 of Tri-comfort Tips 801 on the in-ear utility device (e.g., the wireless in-ear utility device 101 shown in FIG. 1), which can reside in the user's ear canal, where each channel is configured to direct the incoming and outgoing frequencies into the ear canal wall instead of passing straight through, which can allow for additional frequency filtering, therefore when used with a hearing aid the user can increase the gain of a hearing aid using a power receiver and not having issues with feedback to the microphone, and causing both the receiver/microphone to create a loopback high pitch noise, only allowing for low frequencies from the 50 Hz to 300 Hz to pass through allowing for better sound quality enhancement performance and eliminating occultation effects, which enables a balance between hearing aids and output of sound quality, according to a variation of an embodiment.

FIG. 08 illustrates examples of channels 804 and 805 on Tri-comfort Tips 801 that are always open as the wireless in-ear utility device (e.g., the wireless in-ear utility device 102 shown in FIG. 01) is being removed from the user's ear canal, which can prevent painful suction removal of the wireless in-ear utility device 102, according to an embodiment of the technology.

In variations, the channels 804 and 805 are always open when the wireless in-ear utility device (e.g., the wireless in-ear utility device 102 shown in FIG. 01) is removed from the user's ear canal to prevent any suction effect and discomfort or trauma to the user's ear drum.

The channels 804 and 805 can effectively prevent suction effect as the relative pressures on both sides begin to change as the wireless utility device is being removed from the user's ear canal. According to an embodiment of the technology, the channels 804, 805 are always open when the pressure differential on the Frequency Filter 804, 805 differs by approximately 0.125 PSI (but can additionally or alternatively be based on any suitable pressure differential, etc.). The pressure at which the Frequency Filter 804, 805 are open can be for preventing trauma to the eardrum, according to an embodiment of the technology.

Figure 9:
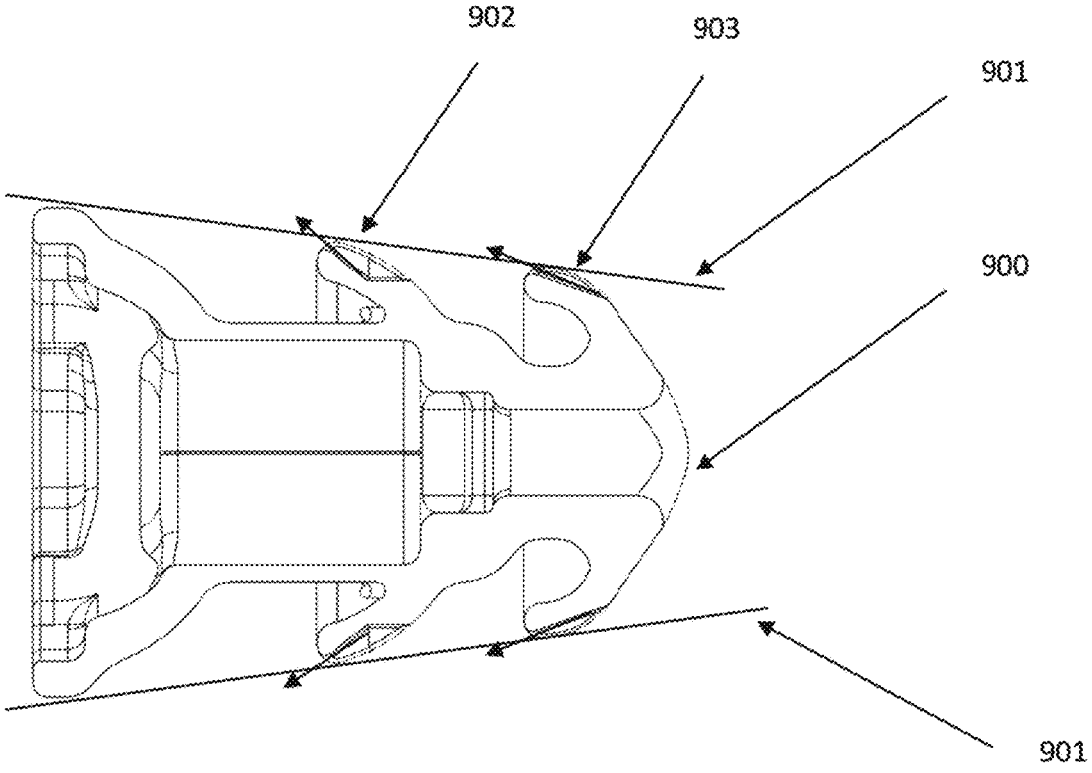
FIG. 9 includes an illustration of a cutaway view of Tri-comfort Tips 900 within an inner wall of the ear canal 90, where, for example, the wireless in-ear utility device (e.g., 102 as shown in FIG. 1) is not shown, and where channels 902 and 903 are designed specifically to direct the frequency path into the inner wall of the ear canal 901, assisting in filtering out the low frequencies from the 50 Hz to 300 Hz to pass through only, where the channels length 1.40 mm and width 0.33 mm (and/or other suitable length and/or dimensions) shown in FIG. 7 at 705 and 703 can also be important in filtering out frequencies, and where, as the dimension vary, the frequencies from the 50 Hz to 300 Hz can change, according to a variation of an embodiment.

FIG. 09 illustrates examples of a cutaway view of channels 902 and 903 on Tri-comfort Tips 900 are open as the wireless in-ear utility device (e.g., the wireless in-ear utility device 102 shown in FIG. 01) is being removed from the user's ear canal, according to an embodiment of the technology.

Figure 10:
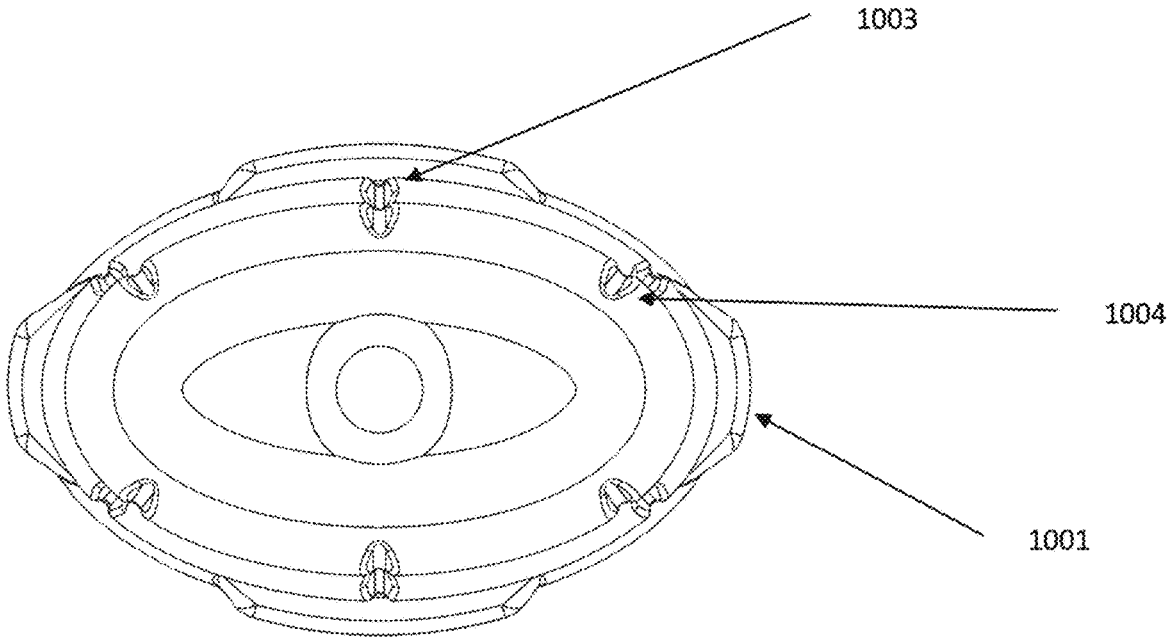
FIG. 10 includes an illustration of an inner channel 1004, and the mid channel 1003 on Tri-comfort Tips 1001 is shown in a rear view 1004 and 1003, where the in-ear utility device with these channels allow for breathability of the ear canal and backpressure relief/suction relief/low frequency filtering in the range of 50 Hz to 300 Hz, where the wireless in-ear utility device (e.g., the wireless in-ear utility device 102 shown in FIG. 1) is not being shown, according to a variation of an embodiment.
Figure 11:
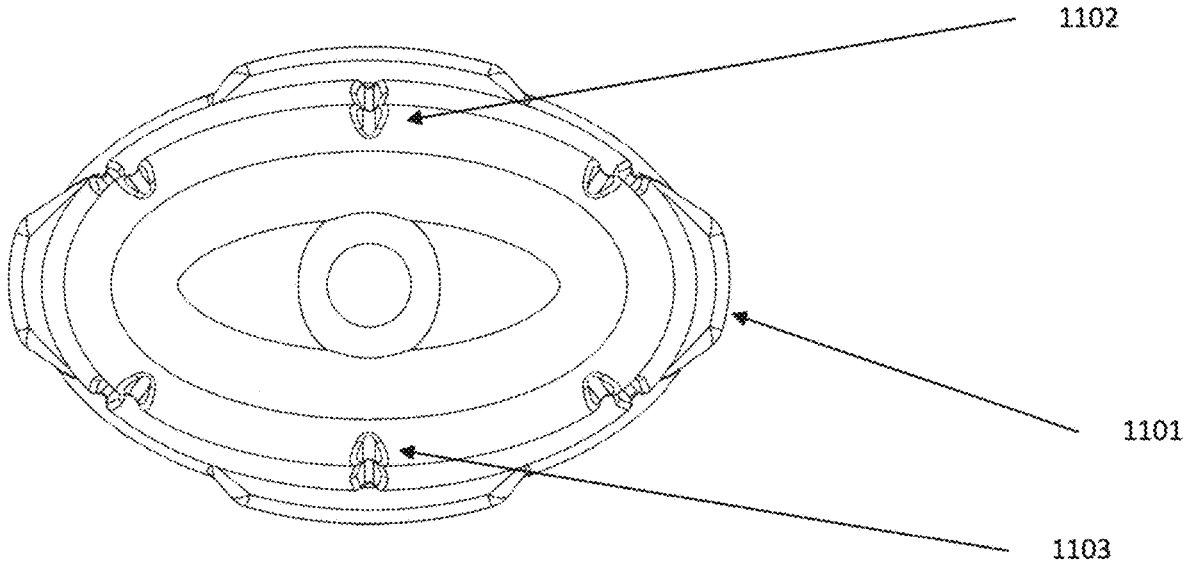
FIG. 11 includes an illustration of the channel openings 1102, 1103 allowing for in-ear breathability of the ear canal and backpressure relief/suction relief/low frequency filtering in the range of 50 Hz to 300 Hz of a Tri-comfort Tips 1101, according to a variation of an embodiment.

FIG. 10 illustrates examples of channels 1003, 1004 on Tri-comfort Tips 1001 shown in a rear view of 1005 channels open as the wireless in-ear utility device (e.g., the wireless in-ear utility device 102 shown in FIG. 01) is removed from the user's ear canal, where the wireless in-ear utility device 102 is not shown, according to an embodiment of the technology.

In examples, the overall length of the Tri-comfort Tips 1101 channels 1102 and 1103 are approximately 0.01 inches, and the width of each channel is 0.03 inches, according to an embodiment of the technology. Additionally or alternatively, the channels 1102 and 1103 can have any suitable size, form factor, dimensions, and weight.

Figure 12:
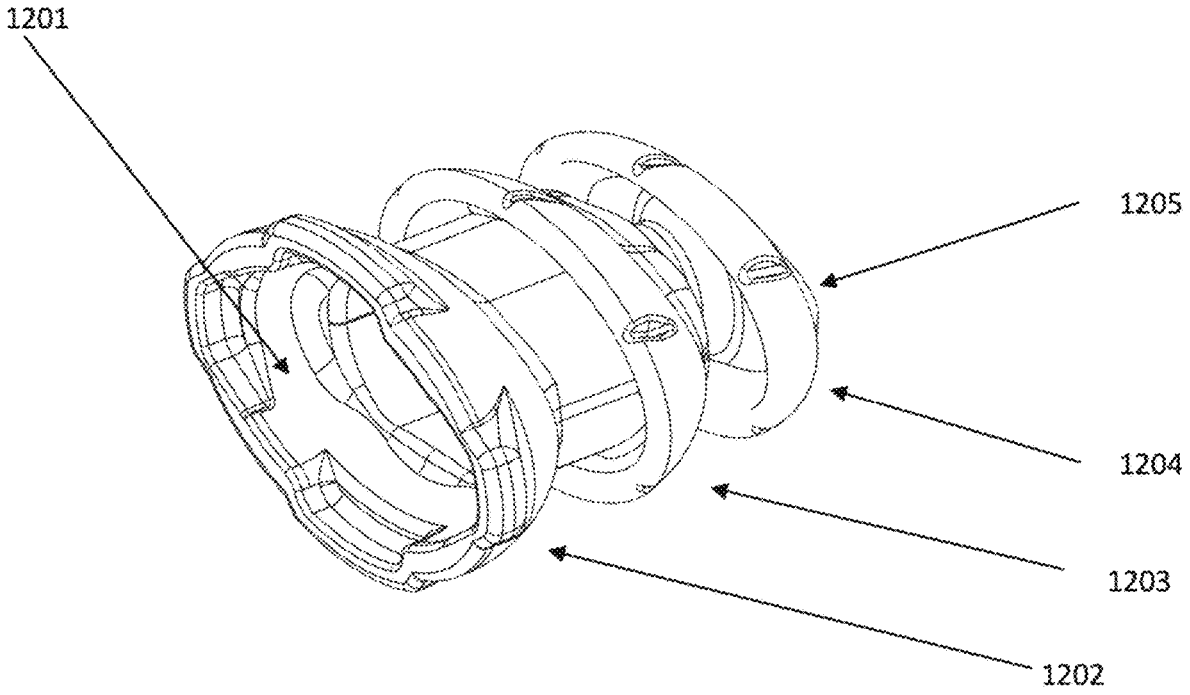
FIG. 12 includes an illustration where anyone of 1202 and 1203 can be bulged as long as there is one channel open in 1202 and 1203 for the breathability for the in-ear canal to maintain in good in-ear health (e.g., the channels openings 1102, 1103 shown in FIG. 11), according to a variation of an embodiment.

FIG. 12 illustrates an example of a bond included of three Tip portions 1202, 1203, 1204 and 1203 and 1204 including channels to a Tri-comfort Tips 1201 viewed from the portion of the Tri-comfort Tips 1205 that rests most closely to the user's tympanic membrane when the in-ear utility device is inserted into the user's ear, according to an embodiment of the technology.

The Tri-comfort Tips 101 and/or channels can be constructed with medical grade Bio-compatible silicone rubber (e.g., could last indefinitely), but can additionally or alternatively be replaced at predetermined time intervals (e.g., once a month, for improved ear health, etc.), and/or at any suitable time and frequency. However, the Tri-comfort Tips 101 and/or channels can be constructed with any suitable materials.

Figure 13:
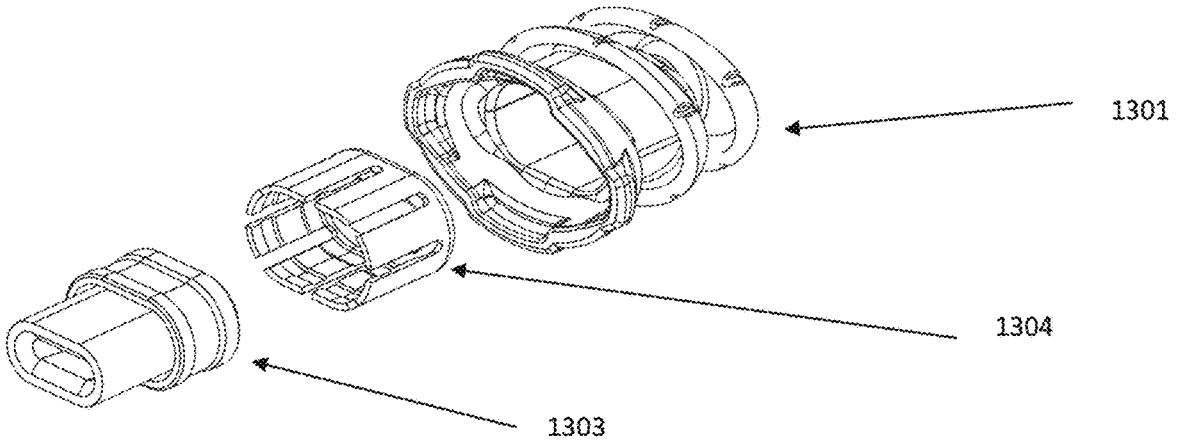
FIG. 13 includes an illustration including three portions of the seal 1301, 1303, 1304 of the Tri-Ear Tips (e.g., the cavity 1201 shown in FIG. 12) to a Tri-comfort Tips 1301 the Tri-comfort Tips the portion of the rear of 1301 that rests most closely to the user's first bend within the ear canal when the in-ear utility device is inserted into the user's ear, according to an embodiment of the technology. In examples, the Tri-Ear Tips portion of the rear 1301 is 5 mm to 10 mm away from the first bend within the ear canal, also known as the junction between the first bend and the second bend within the ear canal, which can prevents the port of the receiver from being plugged, and will prevent it coming near the eardrum, which is to ensure that will not cause any damage to the user's eardrum, according to a variation of an embodiment.
Figure 14:
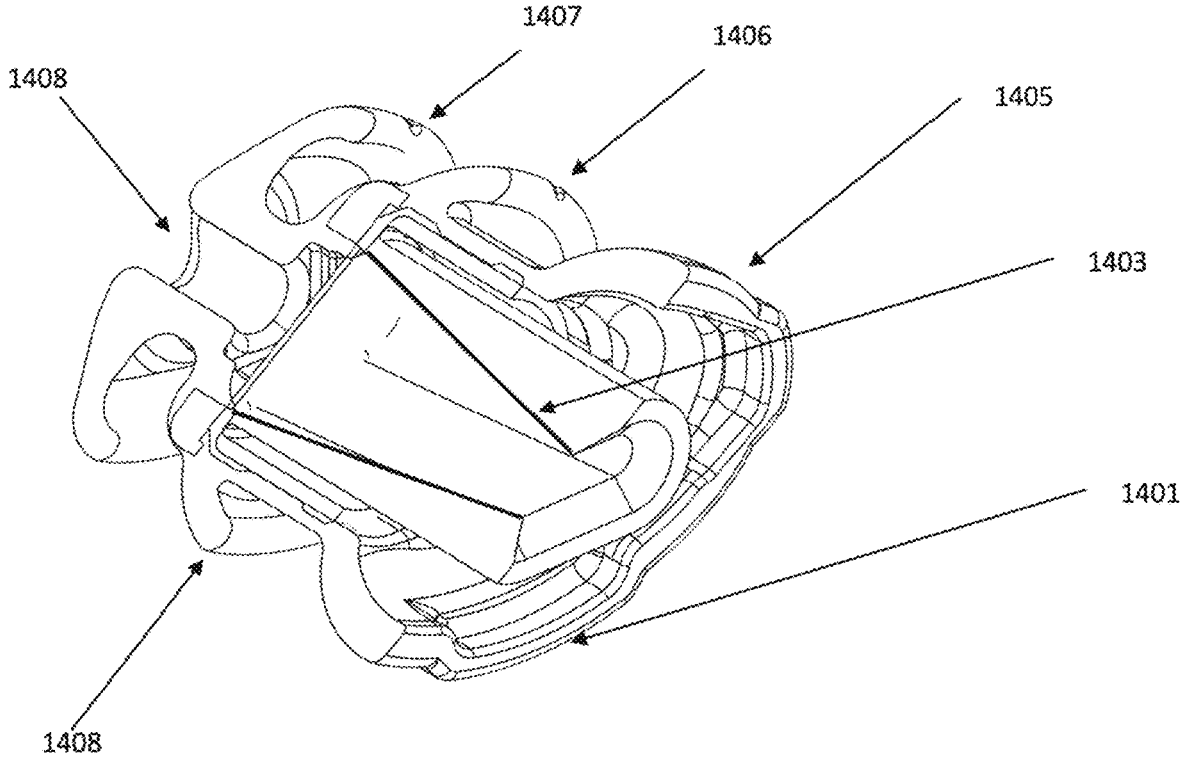
FIG. 14 includes an illustration of a Tri-comfort Tips 1401 including a speaker chamber port 1403 that is designed to have a slope that prevents build up of wax or debris that can block the speaker port 1408, allowing for longer lasting sound quality output, and 1405,1406 and 1407 work independently within the ear canal to prevent 1401 from coming out of the ear, according to a variation of an embodiment.
Figure 15:
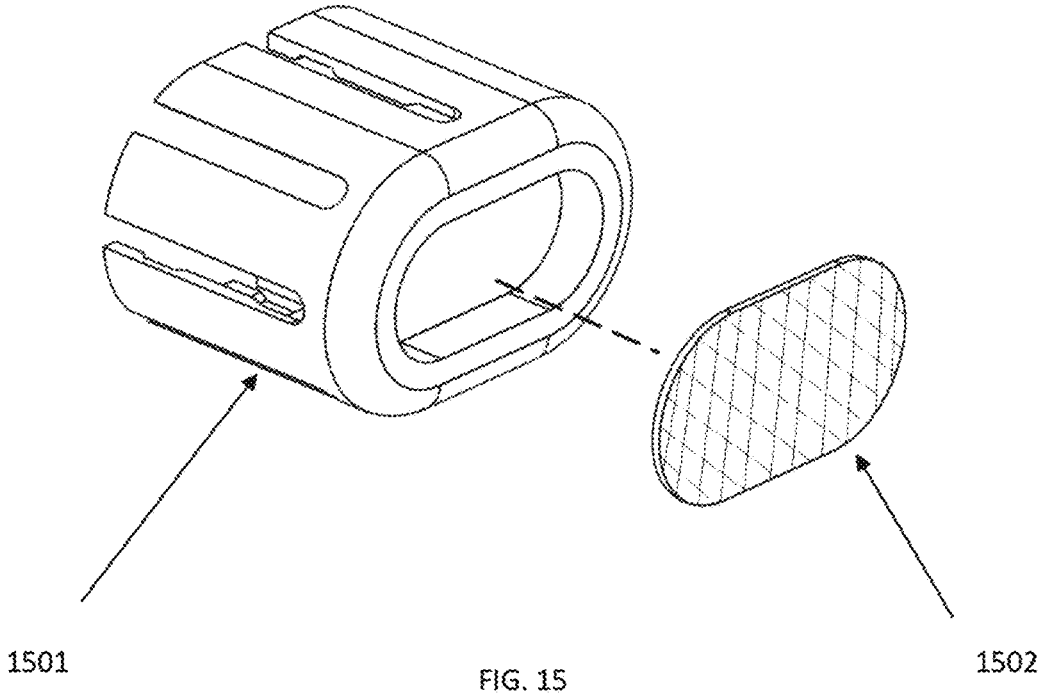
FIG. 15 includes an illustration of the membrane filter of 25 to 30 micron opening (and/or any suitable size of opening) allowing for sound to exit and preventing water and/or any foreign matter from penetrating into the receiver port of the in-ear utility devices/Hearing Aids 102 (e.g., shown in FIG. 01) and 1502 is bonded onto 1501 (e.g., as shown in FIG. 16 as one embodiment 1602, etc.), according to a variation of an embodiment.
Figure 16:
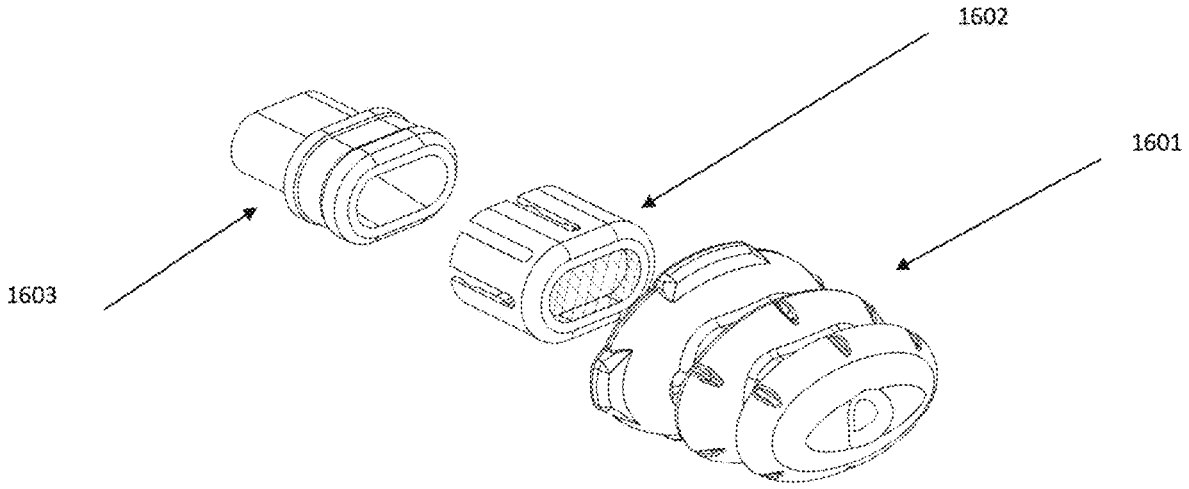
FIG. 16 includes an illustration of the membrane filter with 25 to 3*o* micron opening 1602 that prevents water and/or any foreign matter from penetrating into the in-ear utility device/Hearing Aids 102 (e.g., as shown in FIG. 01, etc.) and 1602 is bonded onto 1601 as one embodiment and can be disposed of after one month, and a fresh one can be used as a replacement on the in-ear utility device (e.g., 102 shown in FIG. 1, etc.), where a filter guard of 25 to 30 micron opening in a Tri-comfort Tips 1601 can be used, and where the in-ear utility device (e.g., 102 shown in FIG. 1, etc.) and 1602 snaps on and off on any in-ear utility device/Hearing Aids 1603, according to a variation of an embodiment.

FIG. 13 illustrates an example of Tri-comfort Tips 1301 designed to work with 1303 that is designed allow for 1302 to clamp onto.

In examples, the degree of inclination of the Tips 1405, 1407, and 1408 the Tri-comfort Tips 1401 in comparison inclined approximately 2 degrees step per tips starting from 1405, according to an embodiment of the technology, but can have any suitable degree of inclination and can be arranged at any suitable angle (and/or degree step) relative other components.

Various embodiments of the technology have been described in detail with reference to the accompanying drawings. References made to particular examples and implementations are for illustrative purposes, and are not intended to limit the scope of the technology or the claims.

It should be apparent to those skilled in the art that many more modifications of the in-ear utility device besides those already described are possible without departing from the inventive concepts herein. The inventive subject matter, therefore, is not to be restricted except by the scope of the appended claims. Moreover, in interpreting both the specification and the claims, all terms should be interpreted in the broadest possible manner consistent with the context.

Headings and sub-headings provided herein have been provided as assistance to the reader and are not meant to limit the scope of the technology disclosed herein. Headings and sub-headings are not intended to be the sole or exclusive location for the discussion of a particular topic.

While specific embodiments of the technology have been illustrated and described, it will be clear that the technology is not limited to these embodiments only. Embodiments of the technology discussed herein may have generally implied the use of materials from certain named equipment manufacturers; however, the technology may be adapted for use with equipment from other sources and manufacturers. Equipment used in conjunction with the technology may be configured to operate according to conventional protocols (e.g., Wi-Fi) and/or may be configured to operate according to specialized protocols. Numerous modifications, changes, variations, substitutions and equivalents will be apparent to those skilled in the art without departing from the spirit and scope of the technology as described in the claims. In general, in the following claims, the terms used should not be construed to limit the technology to the specific embodiments disclosed in the specification, but should be construed to include all variants that operate under the claims set forth herein below. Thus, it is intended that the technology covers the modifications and variations of this technology provided they come within the scope of the appended claims and their equivalents.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

As used herein, and unless the context dictates otherwise, the terms "ambient noise" and "ambient sound" have been used synonymously. Similarly, "sound" and "noise" have been used synonymous, except where the context shows a difference in meaning, e.g., "meaningful sound from mere noise."

The channel frequency filters can be calibrated and tuned in prior to shipping in high volume.

Although omitted for conciseness, the embodiments include every combination and permutation of the various system components and the various method processes, including any variations, examples, and specific examples, where the method processes can be performed in any suitable order, sequentially or concurrently using any suitable system components. Any of the variants described herein (e.g., embodiments, variations, examples, specific examples, illustrations, etc.) and/or any portion of the variants described herein can be additionally or alternatively combined, excluded, and/or otherwise applied.

The system and method and embodiments thereof can be embodied and/or implemented at least in part as a machine configured to receive a computer-readable medium storing computer-readable instructions. The instructions are preferably executed by computer-executable components preferably integrated with the system. The computer-readable medium can be stored on any suitable computer-readable media such as RAMs, ROMs, flash memory, EEPROMs, optical devices (CD or DVD), hard drives, floppy drives, or any suitable device. The computer-executable component is preferably a general or application specific processor, but any suitable dedicated hardware or hardware/firmware combination device can alternatively or additionally execute the instructions.

As a person skilled in the art will recognize from the previous detailed description and from the figures and claims, modifications and changes can be made to the embodiments without departing from the scope defined in the following claims.

I claim:

1. A system comprising:

Tri-comfort Tips comprising a set of leakage slits for in-ear breathability for infection prevention and maintaining dryness of an inner portion of a user's ear canal, wherein the Tri-comfort Tips are configured to reside in the user's ear canal within a first bend of the user's ear canal, wherein the Tri-comfort Tips comprise an end configured to reside in the user's ear canal at a distance less than 16 millimeters from the entrance of the user's ear canal, wherein the Tri-comfort Tips is configured to be snapped off from an in-ear utility device by a user to facilitate replacement with a second Tri-comfort Tips, wherein the Tri-comfort Tips is associated with a snap-off force from 1.5 to 2.5 lbs. for removal from the in-ear utility device.

2. The system of claim 1, wherein the set of leakage slits provide back pressure relief as sound pressure is built up and when inserting seals of the into the user's ear canal, thereby enabling pressure equilibrium with an ambient ear portion.

3. The system of claim 2, wherein the set of leakage slits provide suction relief when removing the seals from the user's ear canal, for preventing pain and ear drum damage.

4. The system of claim 1, wherein the set of leakage slits allow frequency leakage in the range of 50 Hz to 200 Hz.

5. The system of claim 4, wherein the set frequency leakage enables increased output gain while reducing feedback noise from at least one of a microphone and a speaker associated with the Tri-comfort Tips, for improving hearing of a human voice.

6. The system of claim 4, wherein the set of leakage slits with the frequency leakage in the range of 50 Hz to 200 Hz is adapted to listen to outside ambient noise without completely blocking outside noise.

7. The system of claim 4, wherein a width and a length of the set of leakage slits is adapted for defining the frequency leakage in the range of 50 Hz to 200 Hz.

8. The system of claim 1, wherein the Tri-comfort Tips comprise three individual seal tips comprising the set of leakage slits.

9. The system of claim 8, wherein the three individual seal tips are each a different size, wherein the three individual seal tips comprise a first seal, a second seal with a second seal circumference at least 15% smaller than a first seal circumference of the first seal, and a third seal with a third seal circumference at least 15% smaller than the second seal circumference, and wherein the first seal is configured to apply different forces within the user's ear canal from low to medium force.

10. The system of claim 9, wherein the first seal comprises at least four outer structural supports for improving retention within an entrance of the user's ear canal.

11. The system of claim 8, wherein the set of leakage slits comprise a first set of leakage slits proximal an ear drum of the user's ear canal, and wherein the first set of leakage slits comprises at least six leakage slits.

12. The system of claim 8, wherein the three individual seal tips are adapted to a size of the Tri-comfort Tips comprising at least one of an extra small, small, medium, large, and extra large.

13. The system of claim 8, wherein a form factor of the three individual seal tips is adapted to the user's ear canal, wherein the form factor is configured to allowing the three individual seal tips to each apply different forces within the user's ear canal and for the three individual seal tips to apply similar forces within the circumference of the user's ear canal.

14. The system of claim 13, wherein the form factor of the three individual seal tips is configured to enable improved entry into the user's ear canal and to prevent rotation of a utility device when the utility device is connected to the Tri-comfort Tips.

15. The system of claim 8, wherein the three individual seal tips are each a specific distance from each other for reducing overlapping areas that result in reduced sound output quality from over-compression.

16. The system of claim 15, wherein the three individual seal tips are at least 3 mm away from the first bend of the user's ear canal, and wherein the three individual seal tips are each the specific distance from each other while maintaining an overall length of the Tri-comfort Tips as from 12 mm to 16 mm.

17. The system of claim 1, wherein the Tri-comfort Tips comprise a wax guard configured to prevent the speaker (Receiver) port from reducing sound output quality.

* * * * *